US006307307B1

(12) United States Patent
Kanao

(10) Patent No.: US 6,307,307 B1
(45) Date of Patent: Oct. 23, 2001

(54) SPARK PLUG FOR INTERNAL COMBUSTION ENGINE WITH IR ALLOY MOLTEN PORTION OUTSIDE SPARK DISCHARGE REGION

(75) Inventor: Keiji Kanao, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/468,797

(22) Filed: Dec. 21, 1999

(30) Foreign Application Priority Data

Dec. 21, 1998 (JP) ..... 10-363027
Nov. 15, 1999 (JP) ..... 11-324569

(51) Int. Cl.[7] ..... H01T 13/32
(52) U.S. Cl. ..... 313/142; 313/118; 313/141
(58) Field of Search ..... 313/140, 141, 313/143, 118

(56) References Cited

U.S. PATENT DOCUMENTS 4,700,103 * 10/1987 Yamaguchi et al. ..... 313/141
5,461,276 * 10/1995 Matsutani et al. ..... 313/141
5,574,329 * 11/1996 Kagawa ..... 313/141
6,078,129 * 6/2000 Gotou et al. ..... 313/141

FOREIGN PATENT DOCUMENTS

567940 * 5/1958 (BE) .
04-104491 4/1992 (JP) .
08-298178 11/1996 (JP) .

* cited by examiner

*Primary Examiner*—Nimeshkumar D. Patel
*Assistant Examiner*—Thelma Sheree Clove
(74) *Attorney, Agent, or Firm*—Pillsbury Winthrop LLP

(57) ABSTRACT

In a spark plug, molten portions formed by bonding by laser welding a leading end of an Ir alloy element to a leading end of a Ni base alloy base element of a ground electrode to overlap with each other, where Ir alloy and Ni base alloy are mixed with each other, are located outside a region within which the spark is regularly discharged. Another leading end of the Ni base alloy base element is fixed to the housing and both of the Ir alloy element and the Ni base alloy base element extend perpendicular to a housing so that another leading end of the Ir alloy element may face a leading end of the center electrode with the spark discharge gap therebetween.

4 Claims, 13 Drawing Sheets

SPARK PLUG FOR INTERNAL COMBUSTION ENGINE WITH IR ALLOY MOLTEN PORTION OUTSIDE SPARK DISCHARGE REGION

CROSS REFERENCE TO RELATED APPLICATIONS

This application is based upon and claims the benefit of priority of Japanese Patent Applications No. H.10-363027 filed on Dec. 21, 1998 and No. H 11-324569 filed on Nov. 15, 1999, the contents of which are incorporated herein by reference.

BACKGROUND OF THE INVENTION

1. Field of the Invention

The present invention relates to a spark plug for internal combustion engine provided with a ground electrode composed of an Ir alloy element and a Ni or Fe base alloy base element, in particular, applicable to the engine for a co-generation system, a delivery pump for pressurized gas and a vehicle.

2. Description of Related Art

A conventional spark plug has generally a center electrode fitted through an insulator into a housing and a ground electrode fixed to the housing. The center electrode partly exposed out of the end of the insulator faces the ground electrode.

To improve the life time and the performance of the spark plug, a noble metal chip is bonded to the ground electrode (generally, Ni base alloy) to constitute a spark discharge spot at the spark discharge gap.

Conventionally, a platinum (Pt) alloy has been widely used as material for the noble metal chip. However, the Pt alloy has a drawback that the consumption resistance thereof is considered not to be sufficient to meet more sever engine specifications for vehicles in future. Therefor, the use of the iridium (Ir) alloy having a melting point higher than that of the Pt alloy has been recently proposed, as shown in JP-A-8-298178.

For bonding an element made of Ir alloy including more than 50 weight percent Ir (hereinafter merely called Ir alloy) to the ground electrode, a resistance welding is not applicable to secure sufficient bonding strength and a laser beam welding is preferable because the chip and the electrode may be sufficiently molten due to the high density of its energy. However, the portion where Ni and Ir are molten is located near the spark discharge gap and, further, as the Ir content of the molten portion is less than that of the chip of Ir alloy, a spark consumption resistance of the molten portion is worse, compared to that of the chip of Ir alloy itself. Therefore, the molten portion tends to be more rapidly consumed so that the chip of Ir alloy may be left out of the ground electrode.

SUMMARY OF THE INVENTION

The present invention has been made in view of the above mentioned problems, and an object of the present invention is to provide a spark having a construction that molten portions formed by bonding an Ir alloy element to a base element of a ground electrode made of Ni base alloy or Fe base alloy, where Ir alloy and Ni or Fe base alloy are mixed with each other, are located outside a region within which the spark is regularly discharged. As a result, the Ir alloy element can be hardly left out of the ground electrode so that a longer consumption life time of the spark plug may be assured.

To achieve the above object, the spark plug is composed of a center electrode, a housing holding and being insulated with the center electrode so as to expose a leading end of the center electrode out of an end of the housing, and a ground electrode composed of a base element made of Ni or Fe base alloy base and an Ir alloy element. A first leading end of the base element is fixed to the end of the housing at a horizontal side of the leading end of the center electrode. A second leading end of the base element is bonded to a first leading end of the Ir alloy element. Both of the Ir alloy element and the base element extend substantially perpendicular to an axis of the housing so that a second leading end of the Ir alloy element may face the leading end of the center electrode with the spark discharge gap therebetween.

Preferably, a shortest distance L between the center electrode and the molten portions is larger than, more preferably larger by more than 0.2 mm, than a shortest distance G of the spark discharge gap. When the shortest distance L is larger than the shortest distance G as mentioned above, the spark discharge may be prevented from being directed toward the molten portions located on a side of the center electrode so that a consumption of the molten portions may be remarkably limited.

Further, it is preferable to secure a higher bonding strength of the Ni or Fe base alloy base element and the Ir alloy element that a depth of the molten portion entered into the Ir alloy element is not thinner than 0.2 mm but the molten portion does not penetrate through the Ir alloy element. As a result, the Ir alloy element can be hardly left out of the ground electrode so that a longer consumption life time of the spark plug may be assured.

Furthermore, it is preferable to rigidly fix the Ir alloy element to the base element that the second leading end of the base element is provided with a cup shaped hole into which the first leading end of the Ir alloy element is inserted and bonded by welding at a portion where the base element is overlapped with the Ir alloy element.

The Ir alloy mentioned above is preferably more than 50 weight percent Ir including at least one of Rh, Pt, Ru, Pd and W.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
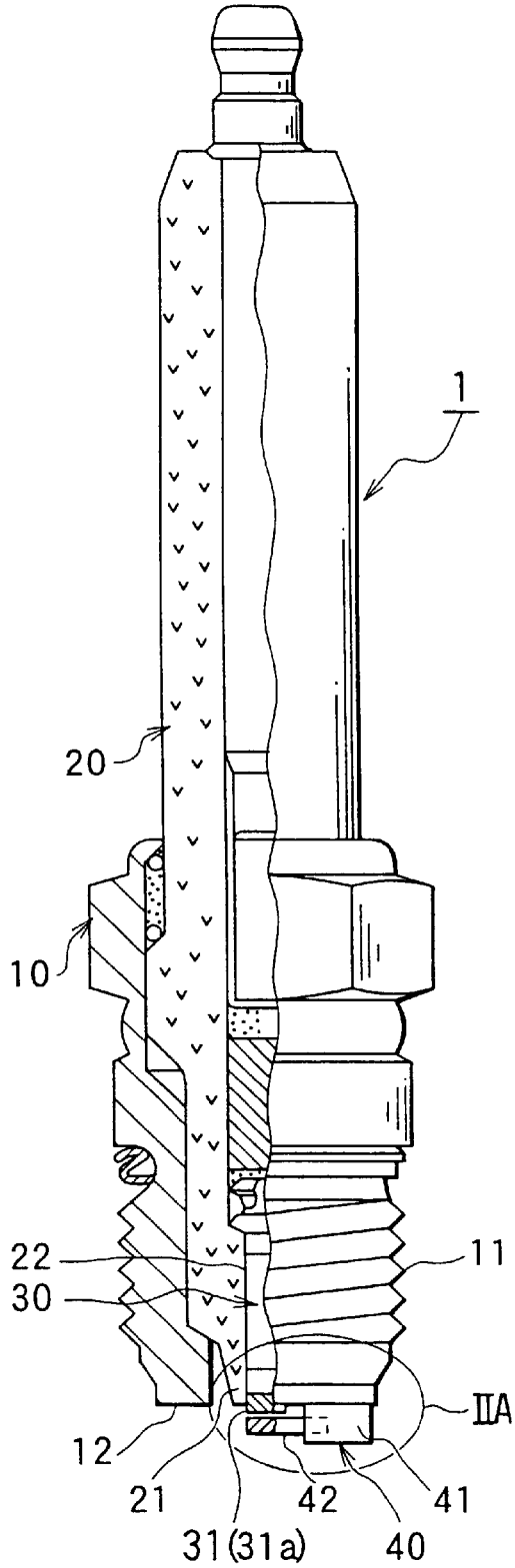
FIG. 1 is a semi cross sectional view of a spark plug according to the present invention.
Figure 2A:
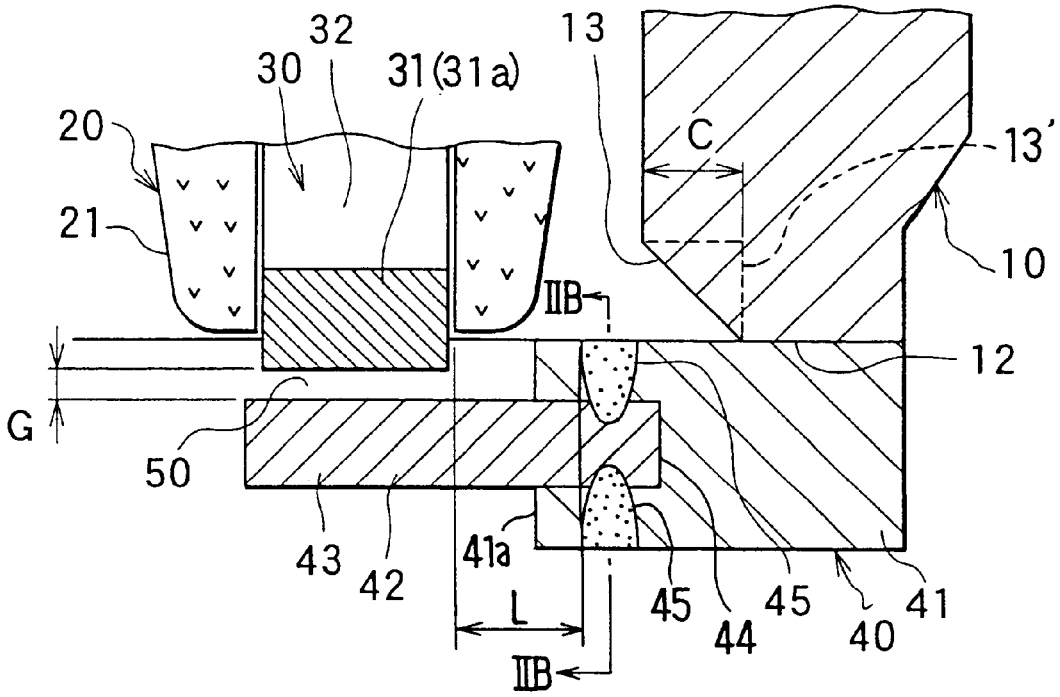
FIG. 2A is a partly enlarged cross sectional view of an encircled A of FIG. 1 according to a first embodiment.
Figure 2B:
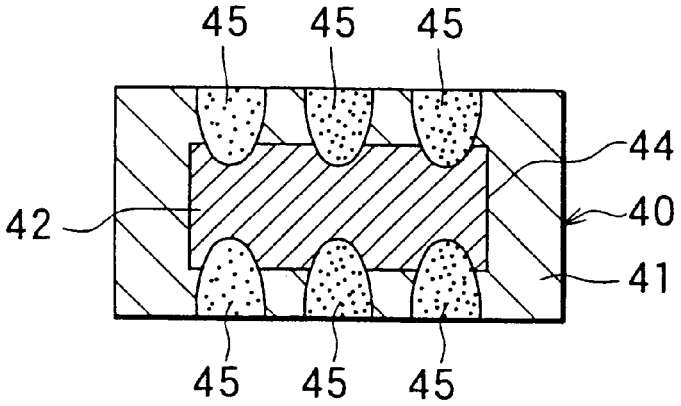
FIG. 2B is a cross sectional view taken along a line IIB—IIB of FIG. 2A.

FIG. 1 shows a semi-cross sectional view of a spark plug for an internal combustion engine according to the present invention. FIG. 2A is a partly enlarged cross sectional view of an encircled portion IIA of FIG. 1 according to a first embodiment and FIG. 2B is a cross sectional view taken along a line IIB—IIB of FIG. 2A. The spark plug 1 according to the present invention is applicable to gas engines for generators in a co-generation system.

The spark plug 1 has a tubular housing 10 having a thread 11 for mounting to an engine cylinder block (not shown). An insulator 20 made of alumina ceramics ($A1_2O_3$) is fitted into the housing 10 and an end portion 21 of the insulator 20 is exposed out of an end 12 of the housing 10. A center electrode 30 is inserted and fixed at a through hole 22 of the insulator 20 so as to be held by and insulated with the housing 10 through the insulator 20. A leading end portion 31 of the center electrode 30 is exposed out of the end portion 21 of the insulator 20. The center electrode 30 is composed of a column shaped main body 32 and a disk shaped Ir alloy chip 31*a* bonded by welding to the main body to constitute the leading end portion 31 mentioned above. An inner member of the main body 32 is made of metal material having good thermal conductivity such as copper and an outer member is made of metal material having good heat resistance and corrosion endurance such as Ni base alloy base alloy.

A ground electrode 40 is composed of a base element 41 made of Ni base alloy and a pillar shaped Ir alloy element 42 fixed by welding to the base element 41. The ground electrode 40 is formed nearly in a straight pillar shape as a whole. The base element 41 is fixed to the end 12 of the housing 10 on a horizontal side of the leading end portion 31 of the center electrode 30. A leading end portion 43 of the Ir alloy element 42 extending from the base element 41 faces the leading end portion 31 of the center electrode 30 to constitute a spark discharge gap 50 therebetween.

The base element 41 is formed in a rectangular block shape and the Ir alloy element 42 is formed in a rectangular shape. A surface of the end 12 of the housing 10 to which the base element 41 is fixed is in parallel with a direction to which the Ir alloy element 42 extends from the base element 41. The surface of the end 12 is provided with a taper shaped chamfering or a step at an edge thereof on a side of the center electrode 30, that is, at an inside surface edge of the end 12 of the housing 10. Another leading end opposite to the leading end 43 of the Ir alloy element 42 is inserted into a bore 44 provided in the base element 41 and fixed to the base element 41 by laser welding. At portions where the base element 41 and the Ir alloy element 42 are bonded, there are provided with molten portions 45, where material of the elements are molten and mixed with each other, extending from an outside surface of the base element 41 to an inside of the Ir alloy element 42 to secure a sufficient bonding strength. Shapes of the molten portions can be observed by looking at cross sections thereof through a microscope for metal.

The Ir alloy chip 31*a* is made of Ir alloy including more than 50 weight percent Ir similar to that of the Ir alloy element 42 for securing a better consumption resistance. The portions where the main body 32 and the Ir alloy chip 31*a* are welded are covered by the insulator 20 as shown in FIG.

2A. Therefore, the molten portions of the center electrode 30 do not have such a consumption problem as the molten portions 45 of the ground electrode 40 have.

The Ni base alloy applied to the outer member of the main body 32 of the center electrode 30 and the base element 41 of the ground electrode 40 may be, for example, INCONEL (trade mark).

The Ir alloy element 42 may be made of the Ir alloy containing more than 50 Wt % of Ir with at least one of materials such as rhodium (Rh), platinum (Pt), ruthenium (Ru), palladium (Pd) and tungsten (W) and, for example, Ir-10 Rh alloy (90 Wt % Ir and 10 Wt % Rh) may be used in this embodiment.

Next, manufacturing processes of the spark plug 1 of the present embodiment is described hereinafter mainly with respect to the ground electrode 40 and the explanation of the manufacturing processes with respect to the other parts is omitted as they are well known.

Figure 3A:
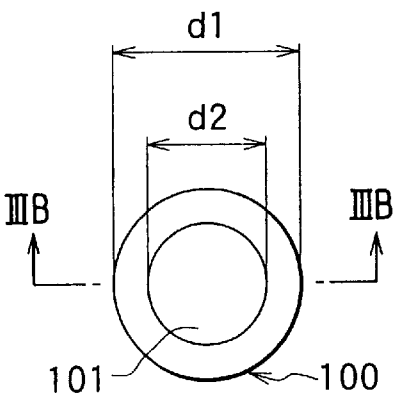
FIG. 3A is a cross sectional view of a part of the spark plug in a first manufacturing process.
Figure 3B:
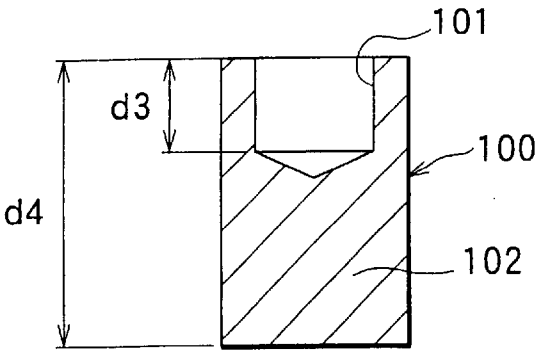
FIG. 3B is a cross sectional view taken along a line IIIB—IIIB of FIG. 3A.
Figure 3C:
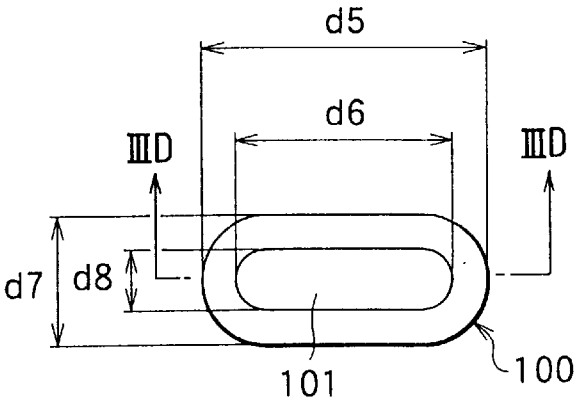
FIG. 3C is a cross sectional view of a part of the spark plug in a second manufacturing process.
Figure 3D:
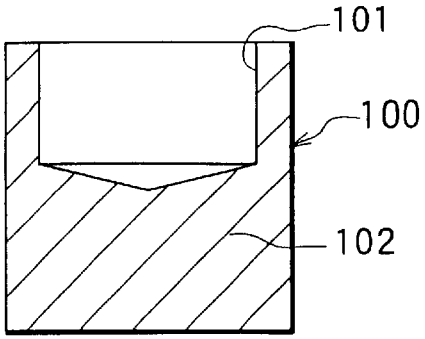
FIG. 3D is a cross sectional view taken along a line IIID—IIID of FIG. 3*c;*
Figure 4A:
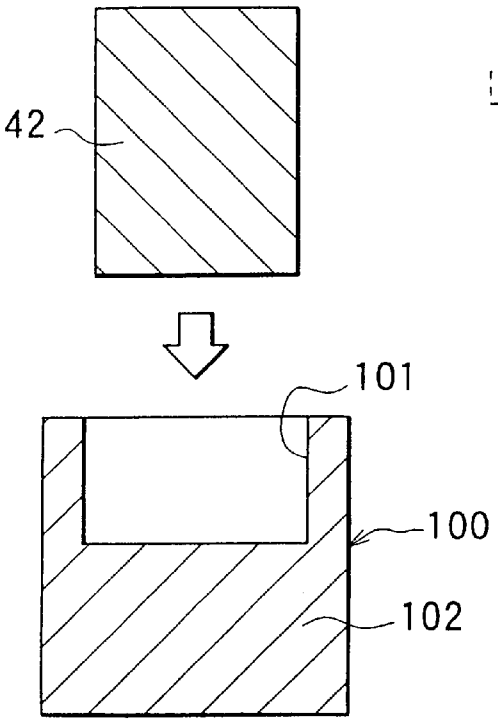
FIG. 4A is a cross sectional view of parts of the spark plug in a third manufacturing process.
Figure 4B:
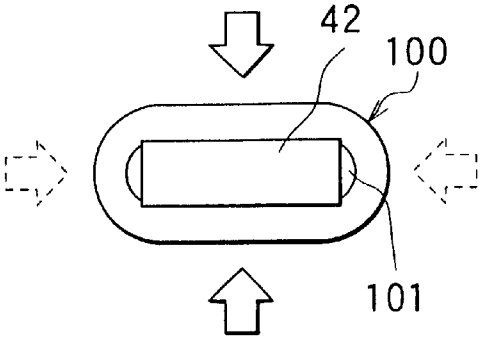
FIG. 4B is a cross sectional view of parts of the spark plug in a fourth manufacturing process.
Figure 4C:
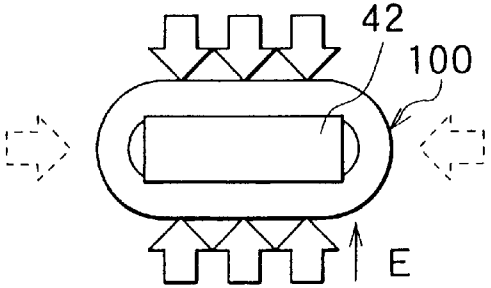
FIG. 4C is a cross sectional view of parts of the spark plug in a fifth manufacturing process.
Figure 4D:
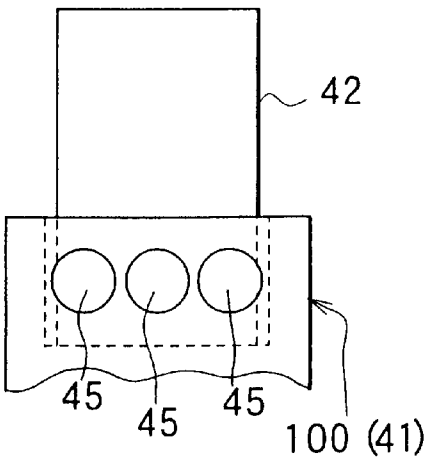
FIG. 4D is an elevation view from an arrow E of FIG. 4C.
Figure 5A:
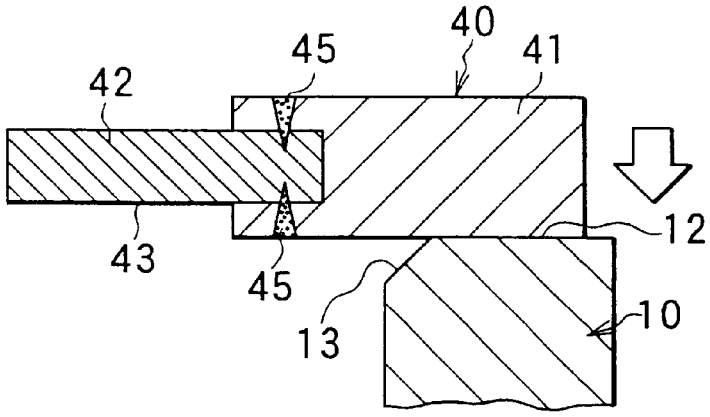
FIG. 5A is a cross sectional view of parts of the spark plug in a sixth manufacturing process.
Figure 5B:
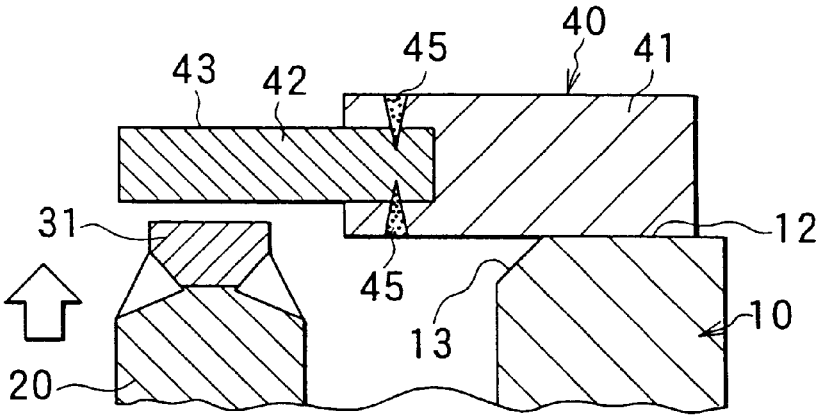
FIG. 5B is a cross sectional view of parts of the spark plug in a seventh manufacturing process.
Figure 5C:
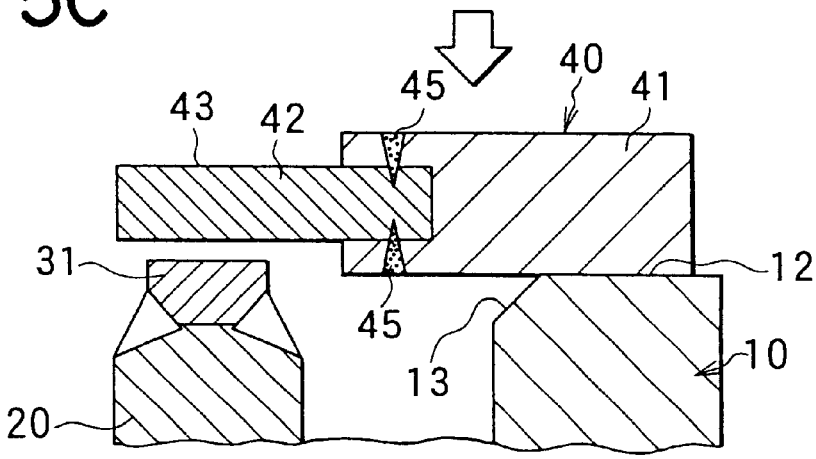
FIG. 5C is a cross sectional view of parts of the spark plug in an eighth manufacturing process.

FIGS. 3A to 3D, 4A to 4D and 5A to 5C show sequentially views of parts of the spark plug 1 in respective manufacturing processes. In particular, FIGS. 5A to 5C show schematically cross sectional views corresponding to FIG. 2A.

At first, a cup 100 made of INCONEL is formed by cold gorging as shown in FIGS. 3A and 3B(cold forging process). FIG. 3B is a cross sectional view taken along a line IIIB—IIIB of FIG. 3A. The cup 100, finally constituting the base element 41, is provided with a tubular shaped cup portion having an opening portion 101 at an end thereof and a closed bottom portion 102 at the other end thereof. As dimensions of the cup 100, for example, an outer diameter d1 is 3.5 mm, an inner diameter d2 is 2.2 mm, a depth d3 of the cup portion is 1.5 mm and a whole length d4 of the cup 100 is 5.5 mm.

Next, the cup 100 is pressed by, for example, 1.0 ton press machine to make an elliptical tubular shape without changing the depth d3 of the cup portion and the whole length d4 as shown in FIGS. 3C and 3D(pressing process). FIG. 3D is a cross sectional view taken along a line IIID—IIID of FIG. 3C. After pressing the cup 100, an outer diameter d5 in a longer radial direction is 4.5 mm, an inner diameter d6 in a longer radial direction is 3.0 mm, an outer diameter d7 in a shorter radial direction is 2.5 mm and an inner diameter d8 in a shorter radial direction is 1.2 mm.

As a next step, the cup 100 after pressing is annealed in a vacuum (vacuum annealing process), for example, for 3 hours at 1000° C. Then, the Ir alloy element 42 is inserted into the cup portion of the cup 100 after annealing from a side of the opening portion 101 as shown FIG. 4A (Ir alloy element inserting process). As dimensions of the rectangular shaped Ir alloy element 42 to be inserted, for example, its width is 2.5 mm, its thickness is 1.0 mm and its length is 5.0 mm.

Further, the cup 100 into which the Ir alloy element 42 is inserted is caulked from both sides or from entire circumferencial directions as illustrated by arrows shown in solid and broken lines of FIG. 4B (caulking process). As a result, the Ir alloy element 42 is fixed to the cup 100.

As a next step, the cup 100 and the Pt alloy element 42 are bonded by laser welding as shown in FIGS. 4C and 4D (laser welding process). FIG. 4D is an elevation view from an arrow E of the FIG. 4C. Laser is applied to the cup 100 from both sides or from entire circumferencial directions as illustrated by arrows shown in solid and broken lines of FIG. 4C, similarly as in the caulking process. As laser welding conditions, for example, energy is 33 J (pulse interval is 15 m sec and charge voltage is 360 V), defocus is +2 mm (a focus point of laser is deep by 2 mm into a radiation surface) and beam diameter of laser is 0.4 mm. The molten portion 45 is formed by radiating laser beam under the conditions mentioned above so that the ground electrode may be integrated into a single body.

Next, the base element 41 of the ground electrode 40, that is, the cup 100, is bonded and fixed by resistance welding to the end 12 of the housing 10 as shown in FIG. 5A (ground electrode fixing process). Then, the housing 10 is assembled on the insulator 20 provided in advance with the center electrode 30 in such a manner that the leading end 43 of the Ir alloy element 42 faces the leading end portion 31 of the center electrode 30 as shown in FIG. 5B (assembly process).

Finally, a distance of the spark discharge gap 50 between the leading end portion 43 of the Ir alloy element 42 and the leading end portion 31 of the center electrode 30 is adjusted by pushing the base element 41 of the ground electrode 40 as shown in FIG. 5C (spark gap adjusting process). Under the processes mentioned above, the spark plug 1 is completed.

In the spark plug 1 according to the present embodiment, the molten portion 45 where the Ir alloy element 42 and the base element 41 are bonded is located far away in a horizontal direction from the spark discharge gap 50 and does not exist in an extended region of the spark discharge gap 50 or in its vicinity. As a result, the Ir alloy element 42 constituting the spark discharge spot may be prevented from being left out of the base element 41 due to the spark discharge consumption so that a longer life time of the spark plug may be secured.

Figure 6A:
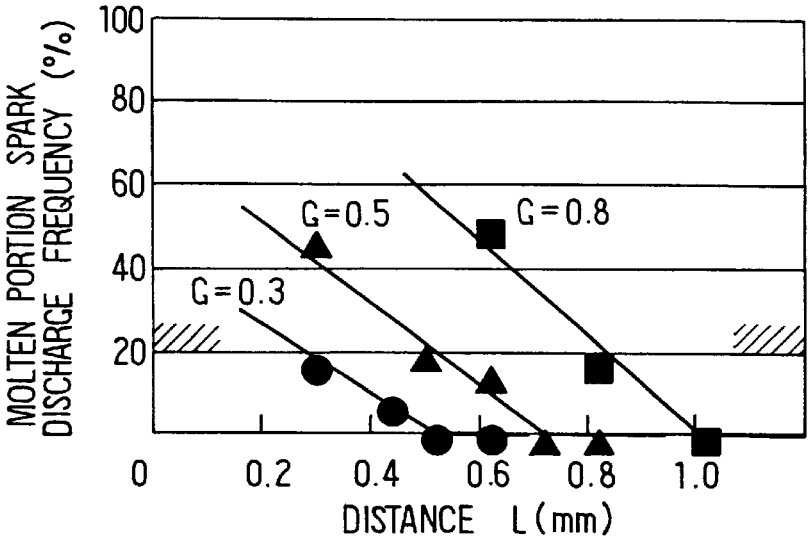
FIG. 6A is a graph showing a relationship among a distance L, a distance G and a molten portion spark discharge frequency.

To achieve the features mentioned above, it is preferable that a shortest distance L between the molten portion 45 and the center electrode 30 is larger, preferably larger by more than 0.2 mm, that a shortest distance G of the spark discharge gap 50. This is concluded by an experimental test on samples having variously different dimensions of the lengths L and G. FIG. 6A shows the test results.

Figure 6B:
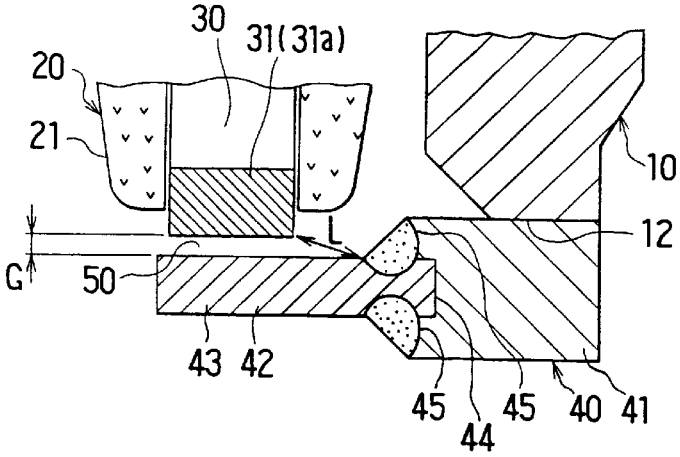
FIG. 6B is a cross sectional view of a spark plug used for a experimental test related to the graph shown in FIG. 6A.
Figure 6C:
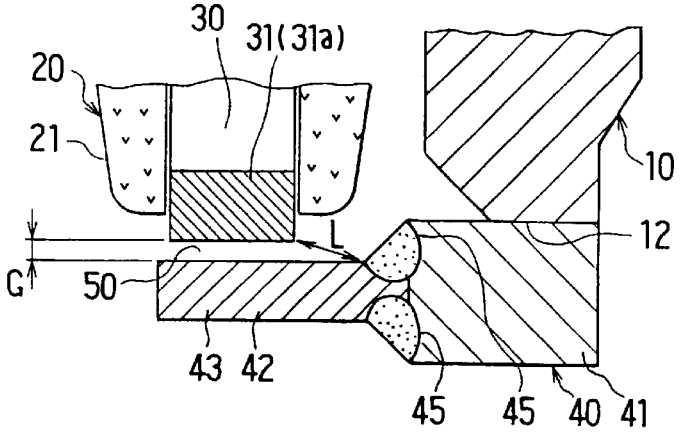
FIG. 6C is a cross sectional view of another spark plug used for a experimental test related to the graph shown in FIG. 6A.

The experimental test was conducted on the spark plugs in which the molten portions 45 face the spark discharge gap 50 as shown in FIGS. 6B and 6C. In the spark plug shown in FIG. 6B, the Ir alloy element 42 is inserted into a bore provided in the base element 41 and the molten portions are formed by laser welding a boundary portion of the Ir alloy element 42 and the base element 41 at the leading end of the base element 41. In the spark plug shown in FIG. 6*c,* the Ir alloy element 42 is in contact with the leading end of the base element 41 and the molten portions are formed by laser welding a boundary portion of the Ir alloy element 42 and the base element 41. The Ir alloy element 42 of the ground electrode 40 and the Ir alloy chip 31a of the center electrode 30 are Ir-10 Rh alloys, respectively. With respect to the samples where the distance G is varied within the range from 0.3 mm to 0.8 mm and the distance L is also varied corresponding to each dimension of the distance G, a frequency of the spark discharged to the molten portions of the base element 41 of the ground electrode 40 (molten portion spark discharge frequency) was measured. The measurement was conducted in a manner that, after the sample spark plugs are installed in a chamber and pressurized at gauge pressure 0.6 MPa, the spark plugs were spark discharged.

As shown in FIG. 6A, when the distance G is 0.3 mm and the distance L is more than 0.5 mm, the distance G is 0.5 mm and the distance L is more than 0.7 mm or the distance G is 0.8 mm and the distance L is more than 1.0 mm, the spark is always discharged at the spark discharge gap 50. Further, when the distance G is 0.5 mm and the distance L is more than 0.5 mm, the spark is discharged to the molten portion 45 only with less than 20% spark discharge frequency. Furthermore, when the distance G is 0.8 mm and the distance L is more than 0.8 mm, the spark is discharged between the molten portion 45 and the center electrode 30 with less than 20% spark discharge frequency. The less than 20% frequency of spark discharge does not cause the molten portions to be substantially deteriorated. Therefore, when a formula, L≧G, more preferably L≧G+0.2 mm, is satisfied, spark discharges occur regularly at the spark discharge gap 50 and irregular spark discharge between the center electrode 30 and the molten portion 45 located in the horizontal direction of the leading end portion 31 of the center electrode 30 my be limited to an extent that the molten portions 45 are not adversely affected.

It is preferable to satisfy the formula, L≧G, more preferably L≧G+0.2 mm, even in a case that the molten portions 45 do not directly face the spark discharge gap 50, as shown in FIG. 2A. This is because of the reason that, when the spark is discharged between the center electrode 30 and the base element 41 in the spark plug shown in FIG. 2A, the base element 41 is gradually consumed so as to expose the molten portions 45 and directly face the molten portions 45 to the spark discharge gap 50. This is proved by the experimental test that if the spark plug shown in FIG. 2A satisfies the formula mentioned above regarding the relationship between the distances G and L, irregular spark discharge between the center electrode 30 and the molten portion 45 may be prevented.

Figure 7:
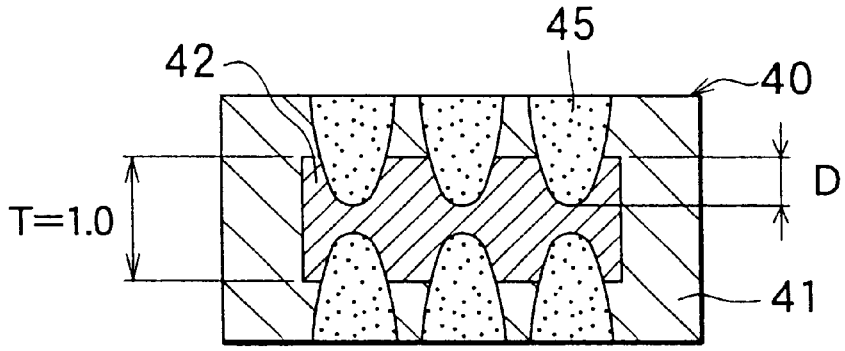
FIG. 7 is a cross sectional view showing molten portions and a molten depth D.

Furthermore, as shown in FIG. 7, which is a cross sectional view corresponding to FIG. 2*b,* a molten depth D of the molten portion 45 entered deep into the Ir alloy element 42 is more than 0.2 mm. In addition, the molten portion 45 does not penetrate through the Ir alloy element 42, that is, the molten portions 45 entered deep into the Ir alloy element 42 from opposite sides are not linked with each other. This was concluded by experimental test results for carrying out in the most effective way the laser welding in order to secure the higher bonding strength of the Ir alloy element 42 and the base element 42.

Figure 8:
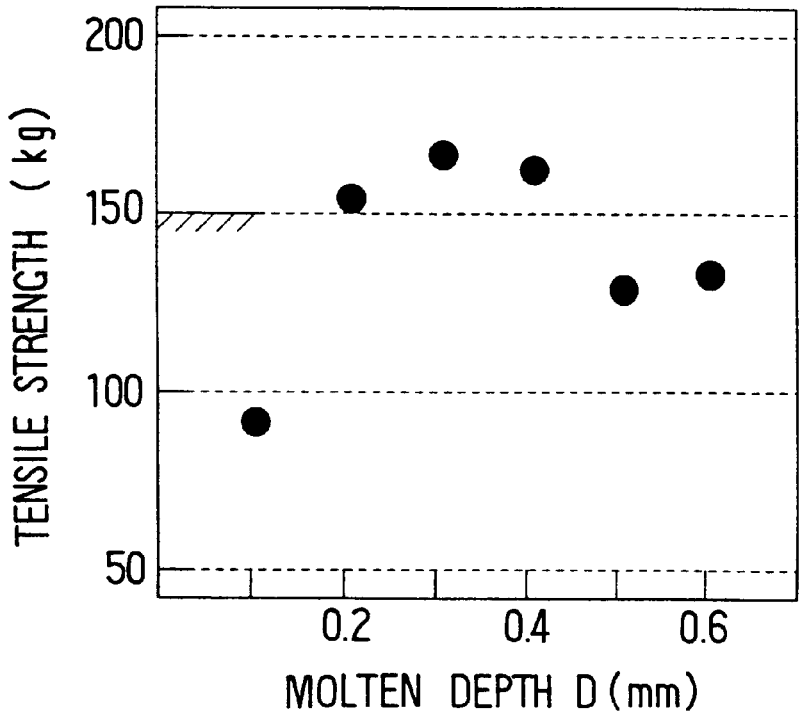
FIG. 8 is a graph showing the relationship between the molten depth and a tensile strength.

FIG. 8 shows a result of the experimental tests. Each of the ground electrode 40 of the spark plugs 1 used for these tests is composed of the base element 41 made of INCONEL and the Ir alloy element 42 made of Ir-10 Rh alloy and the laser welding was radiated at 3 points on each side surface of the ground electrode 40, that is, total at 6 points on opposite side surfaces thereof to prepare test samples having variously different molten depths D. The thickness of the Ir alloy element 42 in a direction of the molten depth D was 1.0 mm.

Then, an endurance test was conducted, in use of a 6 cylinders 2000 cc engine, on the samples mentioned above for 100 hours with one cycle that an idling operation is held for one minute and a full-throttle operation (6000 rpm) is held for one minute. After the endurance test, a tensile strength (kg) of the ground electrode 40 was measured on each of the samples.

FIG. 8 is a graph showing a relationship between the tensile strength (Kg) and the molted depth D (mm). When the tensile strength is more than 150 kg, it is contemplated that the bonding strength is satisfactory. As shown in FIG. 8, when the molten depth D is narrow (less than 0.2 mm), the tensile strength is low. When the molten depth D is more than 0.2 mm, the tensile strength is high so that satisfactory bonding strength may be secured. However, when the molten depth D is too deep (more than 0.5 mm), the tensile strength becomes lower. This is due to the fact that, as the molten portions 45 are arranged to face each other on the opposite sides, the molten portions 45 are linked with each other at 0.5 mm depth, resulting in penetrating through the Ir alloy element 42.

Figure 9A:
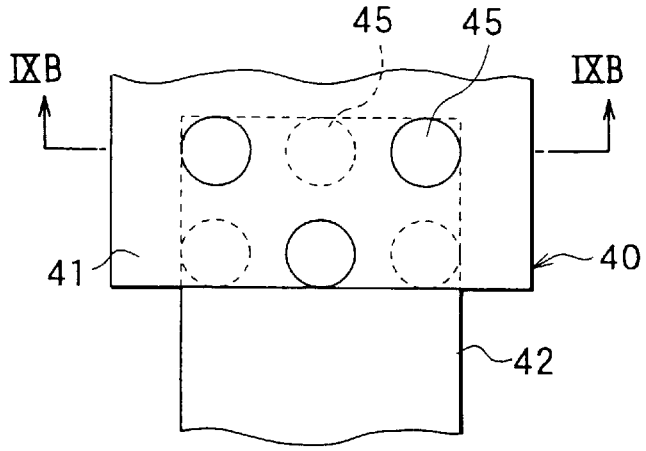
FIG. 9A is a view showing a modified location of the molten portions.
Figure 9B:
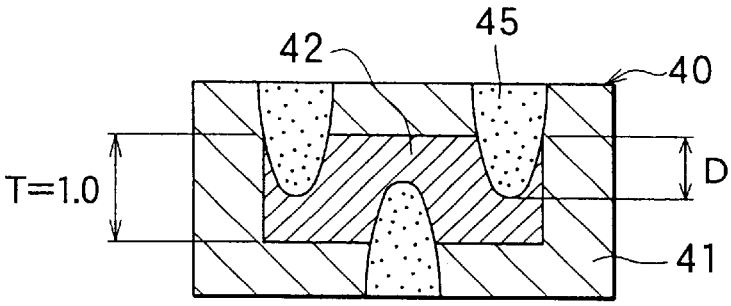
FIG. 9B is a cross sectional view taken along a line IXB—IXB of FIG. 9A.
Figure 10:
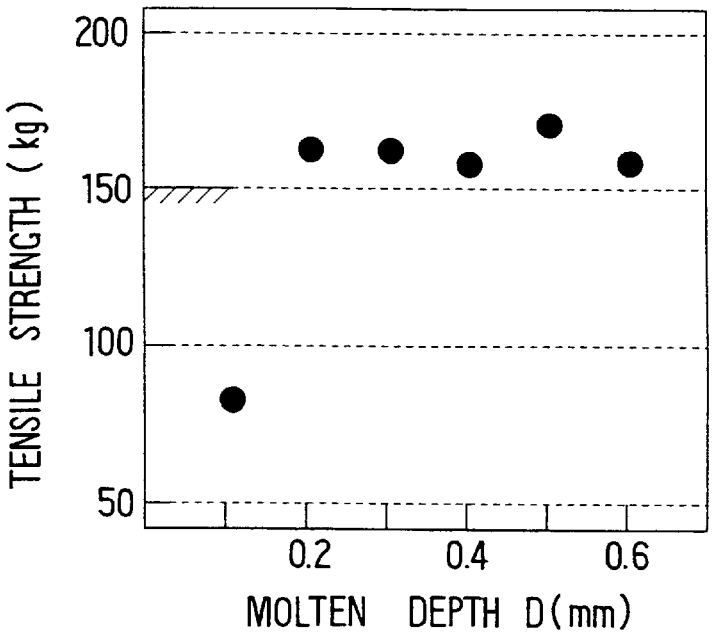
FIG. 10 is a graph showing the relationship between the molten depth and a tensile strength with respect to the molten portions shown in FIGS. 9A and 9B.

On the other hand, when the molten portions 45 are arranged not to face each other but to alternate with each other on the opposite sides of the base element 41 as shown in FIGS. 9A and 9B, the molten portions 45 do not penetrate through the Ir alloy element 42 even if the molten depth D is more than 0.5 mm. Further experimental tests were conducted on the spark plugs having the molten portions alternately arranged as shown in FIGS. 9A and 9B. FIG. 10 shows the test result showing a relationship between the tensile strength (kg) and the molten depth (mm). A thickness T of the Ir alloy element 42 is also 1.0 mm.

As shown in FIG. 10, the tensile strength is not low lo even if the molten depth D is more than 0.5 mm. However, when the molten depth is more than 1.0 mm, that is, when the molten portion 45 penetrates through the Ir alloy element 42, it is proved by test results that the tensile strength is low, though this is not shown in FIG. 10.

As the test results of the spark plugs as shown in FIGS. 7, 9A and 9B, when the base element 41 and the Ir alloy element 42 are bonded by laser welding in such a manner that the molten depth D of the molten portion 45 is not less than 0.2 mm and, further, the molten portion 45 does not penetrate through the Ir alloy element 42, a higher bonding strength can be secured so that the bonding reliability may be remarkably improved.

Further, the spark plug 1 according to the present embodiment is provided with a chamfering 13 at an inside corner of the end portion 12 of the housing 10, that is, at a leading edge of the housing 10 on a side of the center electrode 30. The chamfering 13 may be replaced by a step 13', as shown in dotted lines in FIG. 2A. Further, the chamfering 13 or step 13' may be provided all around the inner circumference of the housing 10 or partly only on a portion where the base element 41 is fixed to the housing 10.

In a case of the spark plug applied to the engine for the co-generation system or the pressurized gas delivery pump, it is common that the spark discharge gap is periodically adjusted because an electrode consumption by the spark discharge is rapidly made. Therefore, when a length of the Ir alloy element 42 is relatively long and a length of the base element 41 is relatively short as is so in the spark plug according to the present embodiment, it becomes effective to have some means for more easily bending the base element 41 to adjust the spark discharge gap 50. A relief such as the chamfering 13 or the step 13' serves to more easily adjust the spark discharge gap 50. A length C of the chamfering 13 or the step 13' in a longitudinal direction of the base element 41 is 1.0 mm in the present embodiment.

As the length C is longer, the ground electrode 40 may be more easily bent. It is preferable, however, that the length C is not longer than 2.0 mm since more than 2.0 mm length of the relief makes too narrow an area where the ground electrode 40 and the housing 10 are bonded so that a reliable bonding strength may not be assured.

Figure 11:
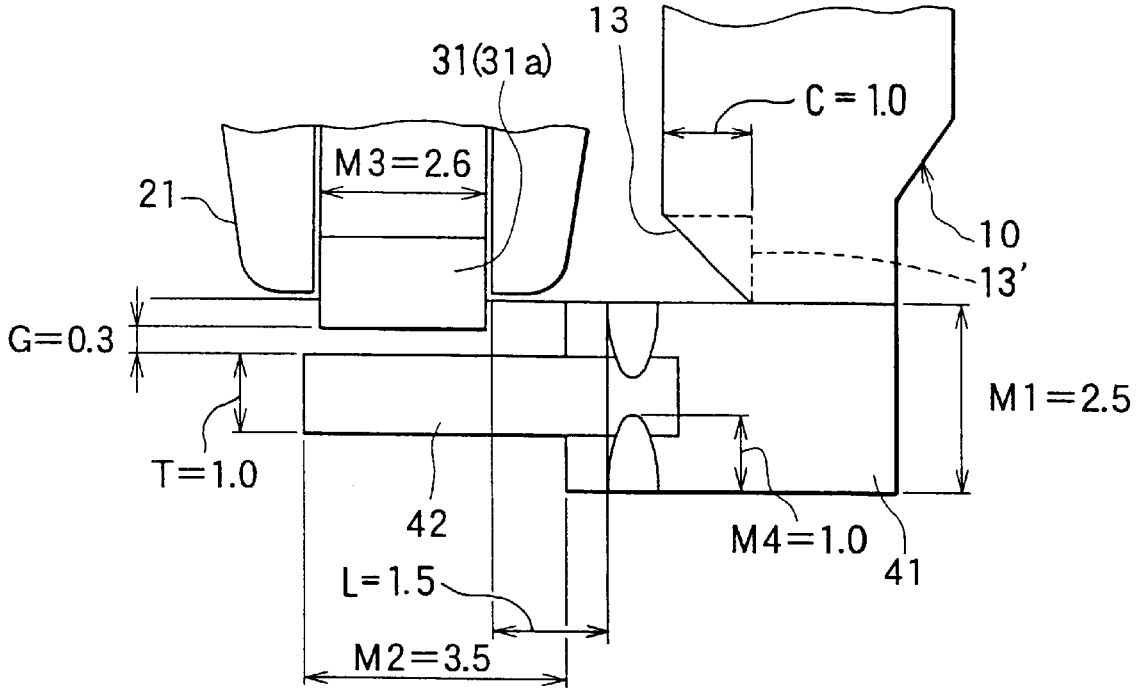
FIG. 11 is a drawing showing dimensions of the spark plug according to the first embodiment.

FIG. 11 shows respective dimensions of the spark plug 1 according to the present invention. FIG. 11 is a drawing corresponding to FIG. 2A without hatching. The unit of the dimension shown in FIG. 11 is millimeter (mm).

The shortest distance G of the spark discharge gap is 0.3 mm, the shortest distance L between the leading end portion 31 of the center electrode 30 and the molten portion 45 is 1.5 mm, a thickness M1 of the base element 41 is 2.5 mm, the thickness T of the Ir alloy element 42 is 1.0 mm, a length M2 of the Ir alloy element 42 extruded out of the base element 41 is 3.5 mm, a diameter M3 of the disk shaped Ir alloy chip 31*a* is 2.6 mm, a length M4 of the molten portion 45 is 1.0 mm and the length C of the chamfering 13 or the step 13' is 1.0 mm.

Figure 12:
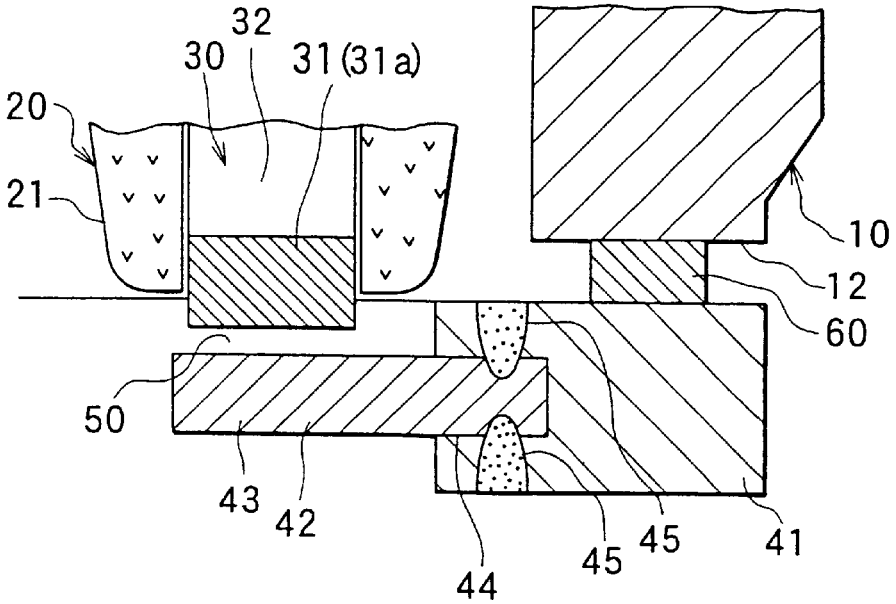
FIG. 12 is a cross sectional view of the spark plug according to a second embodiment.

FIG. 12 shows a spark plug according to a second embodiment. To easily adjust the spark discharge gap 50, in place of the chamfering 13 or the step 13' mentioned above, it is possible to provide a rectangular shaped intermediate element 60 made of Ni base alloy (INCONEL) between the base element 41 of the ground electrode 40 and the housing 10 as shown in FIG. 12.

When a thickness of the intermediate portion 60 in parallel with the longitudinal direction of the base element 41 is thinner than the thickness of the base element 41 or a width of the intermediate portion 60 perpendicular to the longitudinal direction of the base element 41 is shorter than the width of the base element 41, that is, when a cross sectional area of the intermediate portion 60 in parallel with the longitudinal direction of the base element 41 is smaller than a cross sectional area of the base element perpendicular to the longitudinal direction of the base element 41, the intermediate portion 60 itself may be more easily bent to adjust the spark discharge gap 50 when the leading end of the base element 41 on an opposite side to the fixed portion thereof is hammered in order for the leading end portion 43 of the Ir alloy element 42 to come near the leading end 31 of the center electrode 30.

Figure 13A:
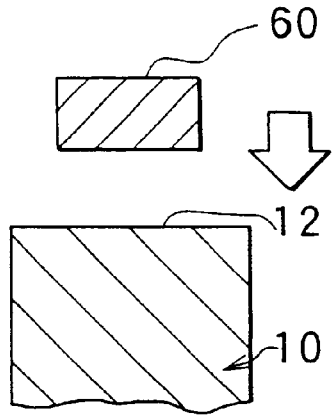
FIG. 13A is a cross sectional view of parts of the spark plug shown in FIG. 12 in a first manufacturing process.
Figure 13B:
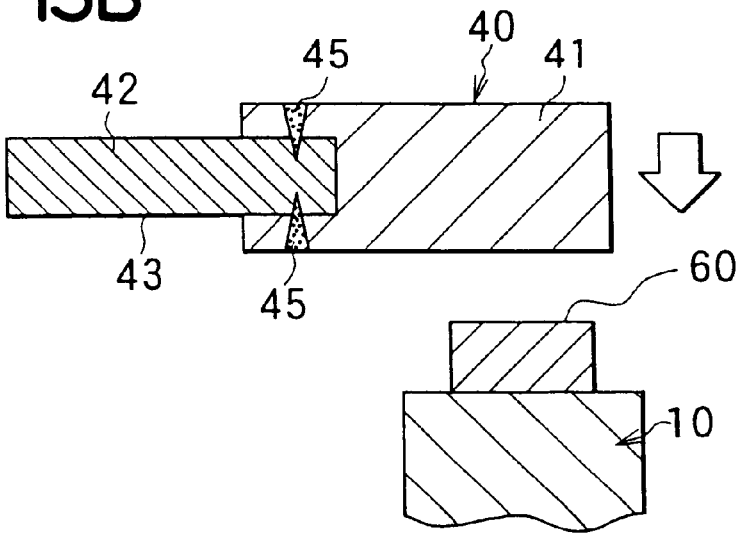
FIG. 13B is a cross sectional view of parts of the spark plug shown in FIG. 12 in a second manufacturing process.
Figure 13C:
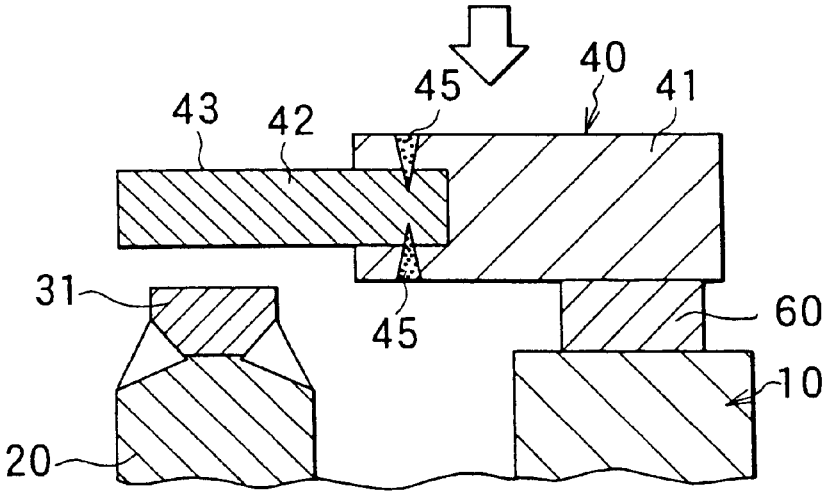
FIG. 13C is a cross sectional view of parts of the spark plug shown in FIG. 14 in a third manufacturing process.

As the manufacturing processes of the spark plug having the intermediate portion 60, at first, an end of the intermediate portion is welded to the end portion 12 of the housing 10 as shown in FIG. 13A. Next, the base element 41 of the ground electrode 40 is welded to the other end of the intermediate portion 60 as shown in FIG. 13B. Then, the spark plug is completed after the assembly process and the spark gap adjusting process as shown in FIG. 13C.

Figure 14A:
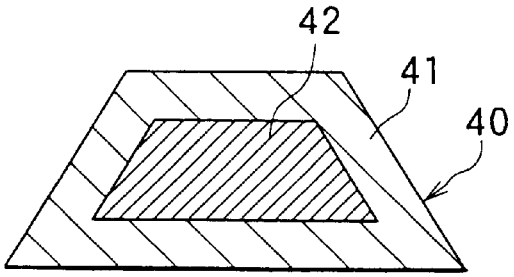
FIG. 14A is a cross sectional view showing a modification of the spark plug according to the present invention.
Figure 14B:
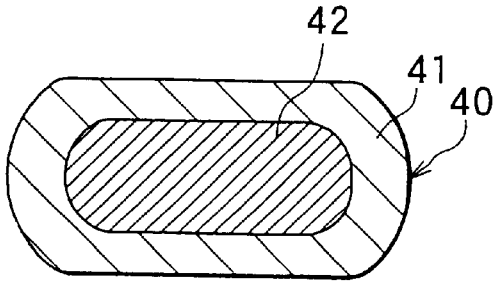
FIG. 14B is a cross sectional view showing another modification of the spark plug according to the present invention.

The cross section of the Ir alloy element 42 is not limited to the rectangular shape as mentioned above and may be any shape, if it is of a pillar type, for example, a trapezoidal or elliptical shape as shown in FIG. 14A or 14B.

Figure 14C:
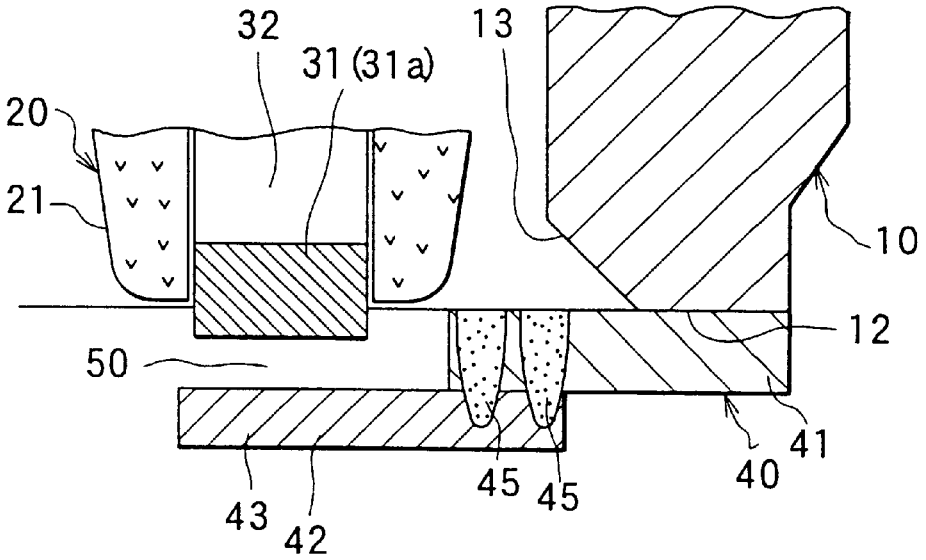
FIG. 14C is a cross sectional view showing a further modification of the spark plug according to the present invention.

Further, as shown in FIG. 14C, the ground electrode 40 may have such a construction that the Ir alloy element 42 is bonded to a surface of the leading end of the base element 41 on an opposite side to the fixed portion thereof to overlap with each other.

Figure 14D:
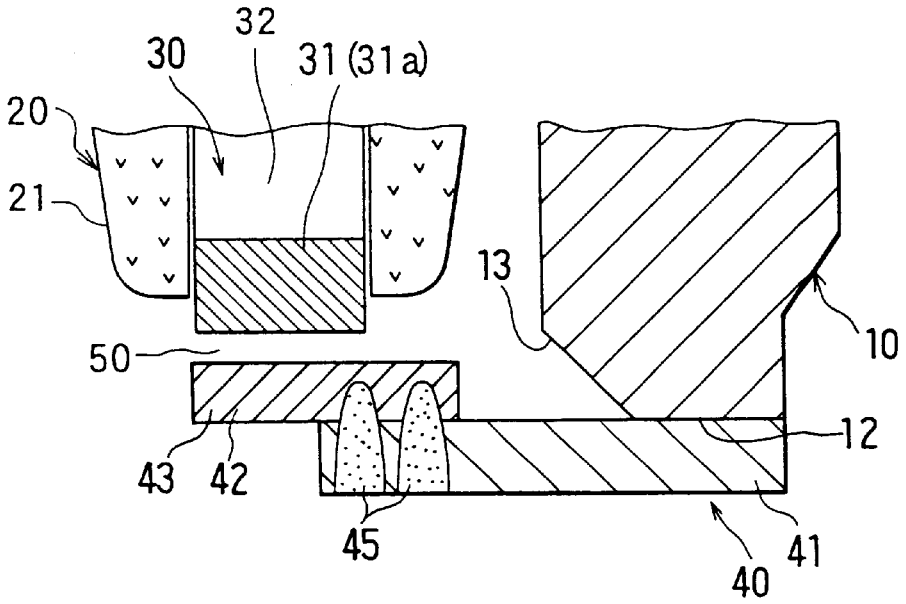
FIG. 14D is a cross sectional view showing a more further modification of the spark plug according to the present invention.
Figure 14E:
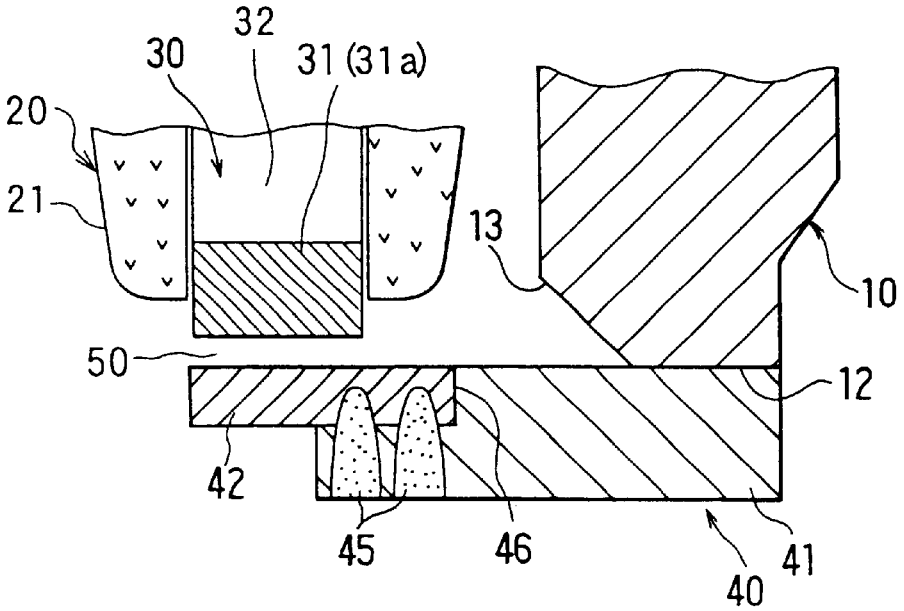
FIG. 14E is a cross sectional view showing a more further modification of the spark plug according to the present invention.

Further, as shown in FIGS. 14D and 14E, the molten portions 45 may be formed on an opposite side of the spark discharge gap 50. After bringing the Ir alloy element 42 contact with the base element 41 on a side of the spark discharge gap 50, as shown in FIG. 14D, or providing a step portion 46 in the base element 41 on a side of the spark discharge gap 50 and making the Ir alloy element 42 contact with the step portion 46, as shown in FIG. 14E, the molten portions 45 are formed by laser welding on the base element 41 at an opposite side of the spark discharge gap 50. The construction that the molten portions 45 are located at the opposite side of the spark discharge gap 50 is preferable because the spark is hardly discharged to the molten portions 45.

Furthermore, the molten portions 45 may be formed at the positions as shown in FIGS. 15A, 15B and 16A, 16B, 16C. In the spark plug shown in FIGS. 15A and 15B, the leading end 41*a* of the base element 41 is provided with a groove 47 having a thickness in a longitudinal direction of the base element 41 and penetrating through the base element 41 in an axial direction of the spark plug. A part of the Ir alloy element 42 is fitted into the groove 47 and the molten portions 45 is formed by laser welding on a surface of the base element 41 perpendicular to a surface thereof facing to the spark discharge gap 50. The molten portions 45 are entered deep into the Ir alloy element 42 parallel to the surface of the base element 41 facing to the spark discharge gap 50.

Figure 15A:
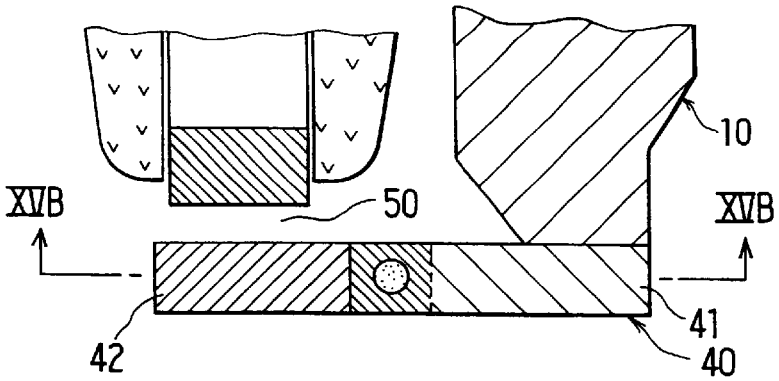
FIG. 15A is a cross sectional view showing a more further modification of the spark plug according to the present invention.
Figure 15B:
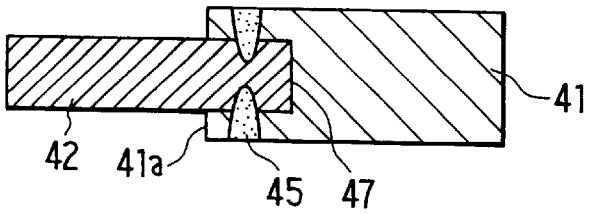
FIG. 15B is a cross sectional view taken along a line XVB—XVB of FIG. 15A.
Figure 16A:
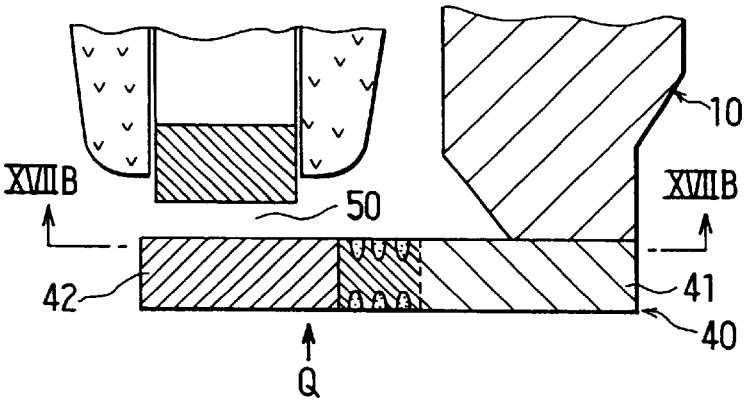
FIG. 16A is a cross sectional view showing a more further modification of the spark plug according to the present invention.
Figure 16C:
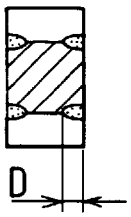
FIG. 16C is a cross sectional view taken along a line XVIC—XVIC of FIG. 15B.
Figure 16B:
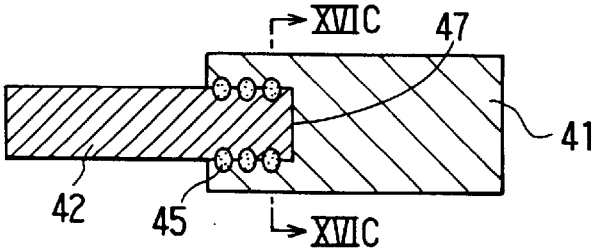
FIG. 16B is a cross sectional view taken along a line XVIB—XVIB of FIG. 15A.

On the other hand, in the spark plug shown in FIGS. 16A, 16B and 16C, the groove 47 is provided in the same way as shown in FIGS. 15A and 15B. A part of the Ir alloy element 42 is fitted into the groove 47 and the molten portions 45 is formed by laser welding at a plurality points along a boundary portion of the base element 41 and the Ir alloy element 42. The molten depth D is as shown in FIG. 16C.

Further, to bond the Ir alloy element 42 to the base element 41 with the molten portions mentioned above, plasma welding or argon welding may be applied instead of the laser welding as mentioned above.

Furthermore, material of the base element 41 of the ground electrode 40 may be a Fe base alloy such as Fe—Cr—Al instead of the Ni base alloy mentioned above.

The spark plug mentioned above is applicable to engines not only for the co-generation systems, but also for pressurized gas delivery pumps and vehicles.

What is claimed is:

1. A spark plug comprising:

a center electrode;

a housing holding and being insulated with the center electrode, a leading end of the center electrode being exposed out of an end of the housing; and a ground electrode composed of a base element made of any one of Ni base alloy and Fe base alloy and an Ir alloy element, a first leading end of the base element being fixed to the end of the housing at a horizontal side of the leading end of the center electrode and a second leading end of the base element being bonded to a first leading end of the Ir alloy element so as to extend both the Ir alloy element and the base element substantially perpendicular to an axis of the housing so that a second leading end of the Ir alloy element is adapted to face the leading end of the center eletrode with a spark discharge gap therebetween, wherein a bonding portion of the Ir alloy element to the base element is located outside a region within which the spark is regularly discharged, the base element and the Ir alloy element are bonded to constitute a molten portion where material of the base element and Ir alloy are mixed with each other, a shortest distance between the center electrode and the molten portion is larger than a shortest distance of the spark discharge gap, and the shortest distance between the center electrode and the molten portion is larger by more than 0.2 mm than the shortest distance of the spark discharge gap.

2. A spark plug according to claim 1, wherein the base element is formed in a straight pillar shape as a whole and the second leading end of the Ir alloy element overhangs the leading end of the center electrode so as to cross an extended axis of the center electrode.

3. A spark plug comprising:

a center electrode;

a housing holding and being insulated with the center electrode, a leading end of the center electrode being exposed out of an end of the housing; and a ground electrode composed of a base element made of any one of Ni base alloy and Fe base alloy and an Ir alloy element, a first leading end of the base element being fixed to the end of the housing at a horizontal side of the leading end of the center electrode and a second leading end of the base element being bonded to a first leading end of the Ir alloy element so as to extend both the Ir alloy clement and the base element substantially perpendicular to an axis of the housing so that a second leading end of the Ir alloy element is adapted to face the leading end of the center electrode with a spark discharge gap therebetween, wherein a bonding portion of the Ir alloy element to the base element is located outside a region within which the spark is regularly discharged, a relief is provided at least at an inside edge of the leading end of the housing to which the first leading end of the base element is fixed, and a length of the relief is not longer than 2.00 mm in a longitudinal direction of the ground electrode.

4. A spark plug according to claim 3, wherein the base element is formed in a straight pillar shape as a whole and the second leading end of the Ir alloy element overhangs the leading end of the center electrode so as to cross an extended axis of the center electrode.

* * * * *